US006262757B1

(12) United States Patent
Masubuchi et al.

(10) Patent No.: US 6,262,757 B1
(45) Date of Patent: Jul. 17, 2001

(54) OPTICAL PRINTER

(75) Inventors: Sadao Masubuchi, Chofu; Sigeru Futakami, Tokorozawa; Masaaki Matsunaga; Masafumi Yokoyama, both of Tokyo; Akira Shiota, Omiya; Shinichi Nonaka, Ageo; Maki Wakita, Sayama; Chikara Aizawa, Fujino-machi, all of (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/155,976

(22) PCT Filed: Feb. 12, 1998

(86) PCT No.: PCT/JP98/00570

§ 371 Date: Oct. 9, 1998

§ 102(e) Date: Oct. 9, 1998

(87) PCT Pub. No.: WO98/35834

PCT Pub. Date: Aug. 20, 1998

(30) Foreign Application Priority Data

| | | |
|---|---|---|
| Feb. 12, 1997 | (JP) | 9-027372 |
| Feb. 12, 1997 | (JP) | 9-027373 |
| Jan. 19, 1998 | (JP) | 10-007474 |
| Jan. 19, 1998 | (JP) | 10-007475 |
| Jan. 19, 1998 | (JP) | 10-007476 |

(51) Int. Cl.[7] ..... B41J 2/47
(52) U.S. Cl. ..... 347/225; 347/232
(58) Field of Search ..... 347/225, 232, 347/233, 234, 235, 238, 241, 129, 130

(56) References Cited

U.S. PATENT DOCUMENTS

| | | | | |
|---|---|---|---|---|
| 4,757,327 | | 7/1988 | Henzi . | |
| 5,105,281 | * | 4/1992 | Kusaka | 347/232 |
| 5,371,531 | * | 12/1994 | Rezanka et al. | 347/43 |

FOREIGN PATENT DOCUMENTS

| | | |
|---|---|---|
| 59-9837 | 1/1984 | (JP) . |
| 1-221271 | 9/1989 | (JP) . |
| 2-169270 | 6/1990 | (JP) . |
| 2-287527 | 11/1990 | (JP) . |
| 3-230972 | 10/1991 | (JP) . |
| 5-242614 | 9/1993 | (JP) . |
| 6-316109 | 11/1994 | (JP) . |
| 7-43669 | 2/1995 | (JP) . |
| 7-311495 | 11/1995 | (JP) . |
| 8-201930 | 8/1996 | (JP) . |

* cited by examiner

*Primary Examiner*—N. Le
*Assistant Examiner*—Lamson D. Nguyen
(74) *Attorney, Agent, or Firm*—Smith, Gambrell & Russell, LLP

(57) ABSTRACT

The present invention employs LEDs and a liquid crystal shutter driven in synchronization with the position of the photosensitive paper, thereby eliminating image distortion even where the head of the optical printer apparatus is subjected to unanticipated load during scanning by the head. A rotary encoder (320) is provided on the rotating shaft of the motor (310) that drives the optical head (100), and the drive timing for the LEDs (110) and the liquid crystal shutter (150) is synchronized with the output of the rotary encoder.

41 Claims, 14 Drawing Sheets

OPTICAL PRINTER

TECHNICAL FIELD

This invention relates to an optical printer apparatus for producing images by introducing relative motion of an optical head with respect to a photosensitive medium while exposing the medium under predetermined timing, and more particularly to a structure for supporting the optical head, a drive mechanism of the optical head, and an exposure timing control technique.

BACKGROUND ART

Video printers are widely used for printing onto a photosensitive sheet images digitally processed and displayed on a display. Printing methods for video printers include thermal method, ink-jet method, laser beam scanning method, and liquid crystal shutter method. Of these methods, the optical printer method, wherein the image is formed by exposure of a photosensitive medium with light from a light source under exposure timing controlled by a liquid crystal shutter, has attracted attention for its suitability to compact, lightweight designs. Prior art examples of such optical printer method are disclosed in Japanese Laid-Open Patent Application 2-287527 and 2-169270.

The prior art examples cited above will be described referring to FIG. 16. In FIG. 16, a casing 11 houses a film loading section 12 that contains a film pack FP containing a plurality of sheets of self-processing film F, each being a photosensitive medium. Located adjacent to the opening 13 of the film loading section 12 is a set of transport rollers 16 comprising a pair of rim drive rollers 14*a* and 14*b* for drawing out by gripping therewith a predetermined single sheet of film F, which has been exposed, from the film pack FP housed in the film loading section 12 and a pair of ironing rollers 15*a* and 15*b* for developing the exposed film F.

An exposing and recording section 17 for producing the image on the film F is disposed between the rim drive roller pair 14*a* and 14*b* and the ironing roller pair 15*a* and 15*b*. The exposing and recording section 17 includes a light source 18 such as a halogen lamp, and is designed so that the film F is exposed to the light from this light source 18 through an optical fiber bundle 19, color filters (not shown) of three colors (RGB) disposed parallel to the image auxiliary scanning direction, a liquid crystal light valve 20, and a gradient index lens array 21.

A polarizing plate is disposed above and below and to the sides of the liquid crystal light valve 20 with the direction of polarization thereof oriented parallel. A first glass substrate is disposed to the inside of the polarizing plate, one face of this first glass substrate being provided through vacuum evaporation with thin films consisting of coloring matters of three different colors (R, G, and B) that serve as color filters (not shown). The other face is provided with transparent electrodes arranged along the color filters (not shown), i.e., a plurality of pixel electrodes disposed in linear fashion in the auxiliary scanning direction.

Liquid crystals such as twisted nematic liquid crystals are sealed between the pixel electrodes and a second glass substrate. At the interface of the second glass substrate with the liquid crystals, a common electrode, being a transparent electrode, is produced through vacuum evaporation at the side of the second glass substrate. The aforementioned polarizing plate is located on the other side of the second glass substrate; light passing through this polarizing plate is directed through the gradient index lens array 21 for the exposure of the film F.

The prior art described above, however, lacks means for accurately controlling the relative motion of the photosensitive medium and the exposure light, and thus has the drawback of image distortion caused by deviation in the speed of relative motion of the photosensitive medium and the exposure light.

Accordingly, it is an object of the present invention to provide an optical printer apparatus that overcomes the aforementioned drawbacks of optical printer apparatuses of the prior art, by assuring a constant relative motion speed of photosensitive medium and exposure light over the entire scanning area, thereby affording images that are free from distortion.

It is a further object of the present invention to provide an optical printer apparatus equipped with a head support structure capable of stably supporting over the entire scanning area the optical head that emits the exposure light.

DISCLOSURE OF THE INVENTION

An optical printer apparatus comprising an optical head for irradiating a photosensitive medium with exposure light in order to produce an image and a motor for introducing relative motion of the optical head and the photosensitive medium over a predetermined scanning area, the optical head and the photosensitive medium being induced to undergo relative motion at a predetermined speed in order to produce an image on the photosensitive medium, wherein the optical printer apparatus further comprises displacement sensing means for sensing relative displacement of the optical head with respect to the photosensitive medium, and the exposure timing of the optical head is synchronized with the output of the displacement sensing means.

BEST MODE FOR CARRYING OUT THE INVENTION

The invention will be illustrated in greater detail below through the following description referring to the accompanying drawings.

Figure 1:
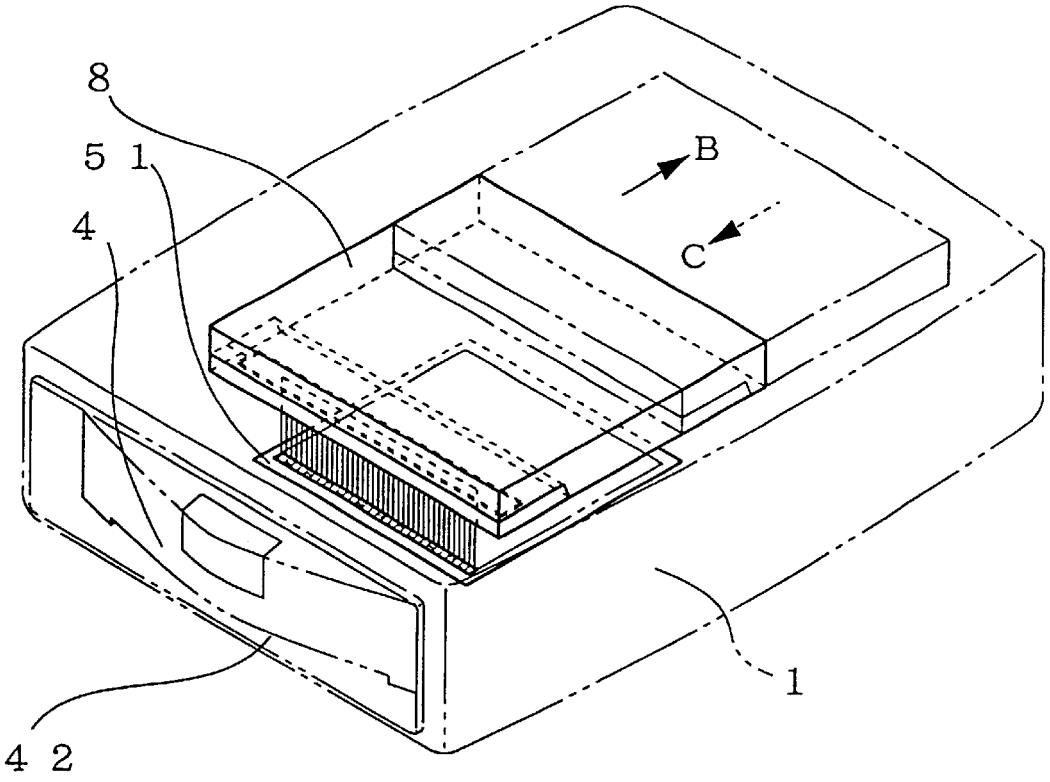
FIG. 1 is a perspective view of the exterior of the optical printer apparatus which pertains to the present invention.
Figure 2:
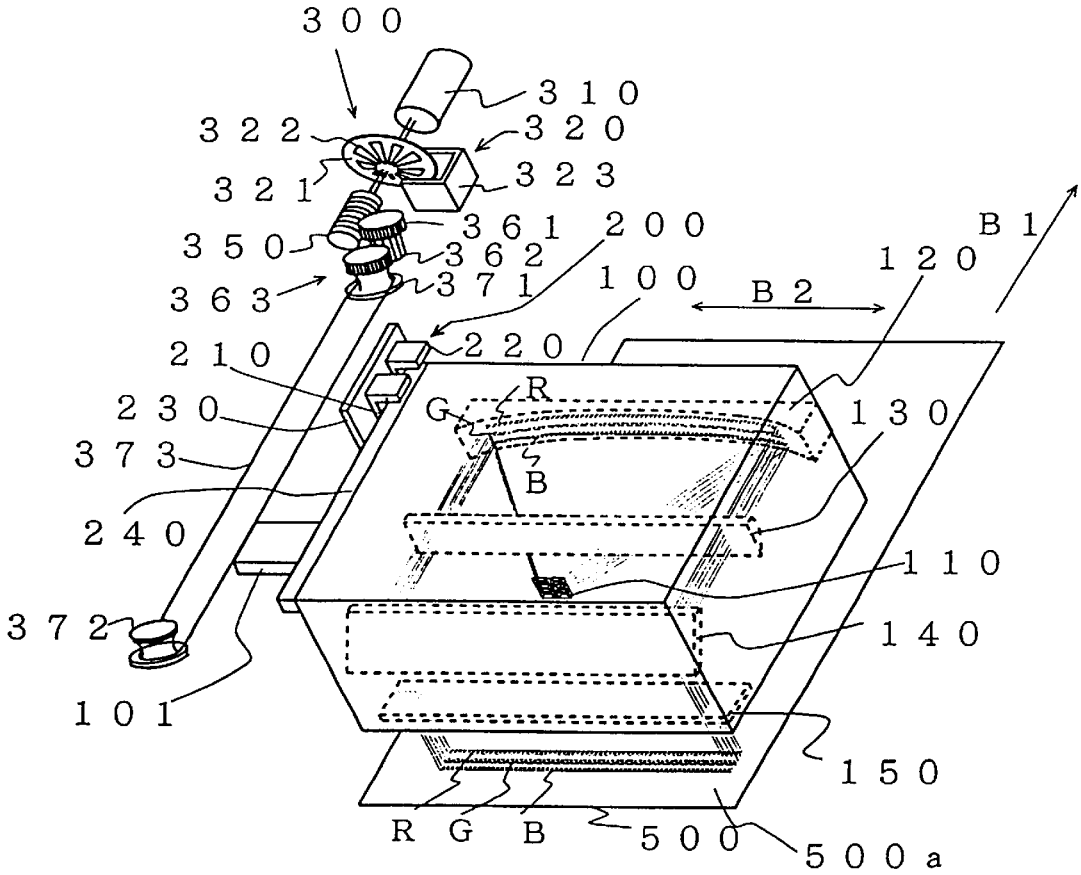
FIG. 2 is a perspective view of principal elements of the optical printer apparatus which pertains to the present invention.
Figure 3A:
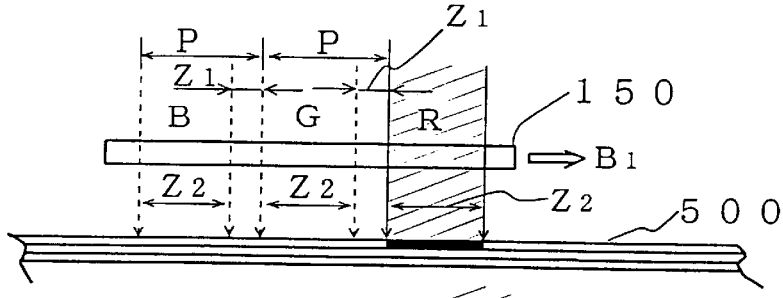
FIGS. 3(*a*)–3(*f*) are diagrams illustrating the basic principle of image formation by the optical printer apparatus which pertains to the present invention.
Figure 3B:
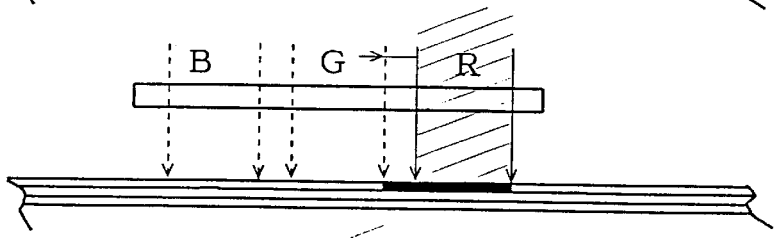
Figure 3C:
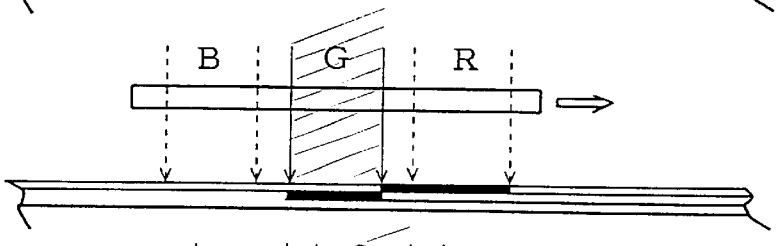
Figure 3D:
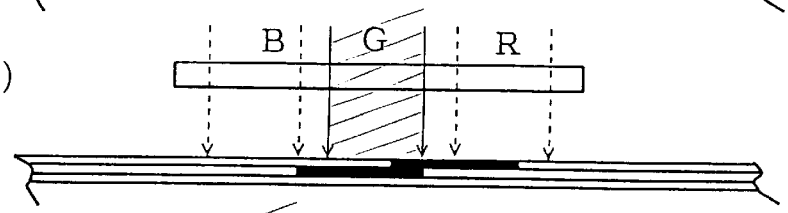
Figure 3E:
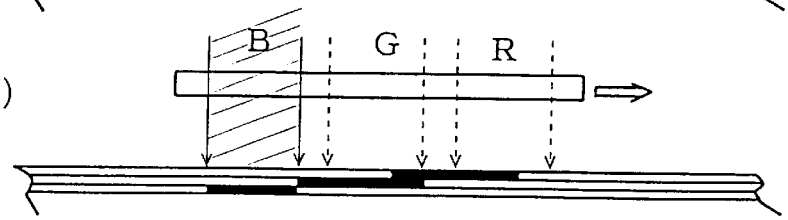
Figure 3F:
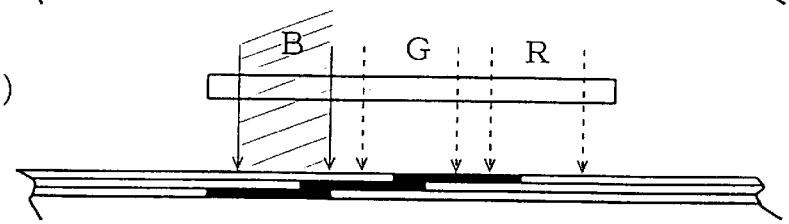
Figure 7:
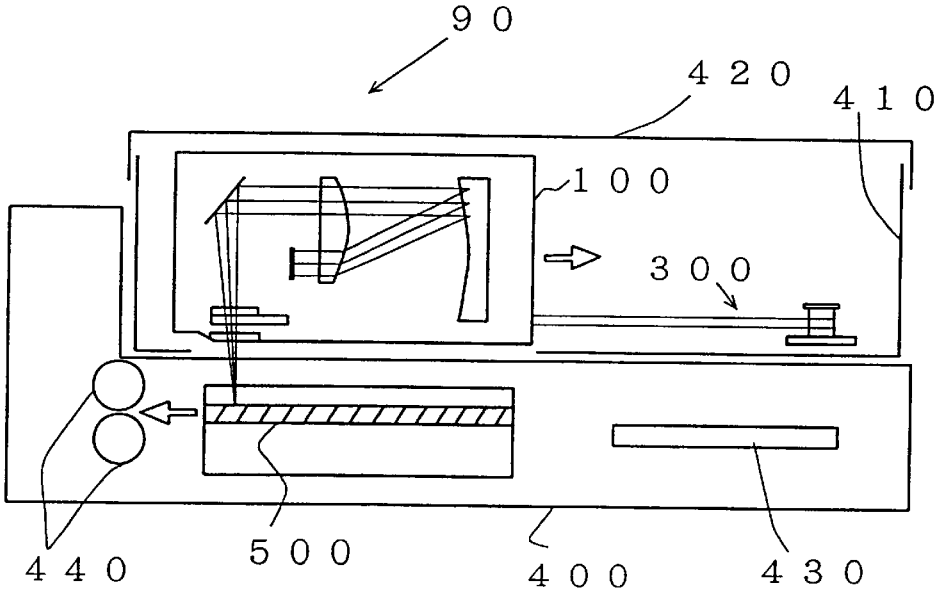
FIG. 7 is a simplified sectional view depicting a general construction of the entire optical printer apparatus which pertains to the present invention.

FIG. 1 is a perspective view showing the scheme of the optical printer apparatus which pertains to the present invention. The essential constitution and operation of the optical printer apparatus in this embodiment will be described referring to FIG. 1. The housing 1 contains a photosensitive sheet tray 42 that can be inserted and drawn out like a drawer. An optical head 4 is mounted so as to be able to make a reciprocating motion in the directions indicated by arrow B and arrow C, while facing the photosensitive face of the photosensitive sheets contained in the photosensitive sheet tray 42. FIG. 2 and FIG. 7, discussed later, show the optical printer apparatus with its housing 1 removed, and their external appearances are like that of FIG. 1.

Referring to FIG. 2, the construction of the optical printer apparatus which pertains to the present invention will be described in detail.

FIG. 2 is a perspective view of principal elements of the optical printer apparatus which pertains to the present invention. 100 is an optical head that houses the elements of the optical system; the head feed means 300 causes the optical head 100 to scan photosensitive paper 500 in the direction indicated by arrow B1.

The constitution of the optical head 100 will now be described. 110 is a light source made up of a light-emitting diode (LED) array LEDs arranged in rows, wherein pairs of LED elements that emit red (R), green (G), and blue (B) are arranged in two rows, with R, G, and B being arrayed in that order descending in the direction perpendicular to the photosensitive face 500*a* of the photosensitive paper 500. 120 is a parabolic mirror for reflecting the light coming from the LED array 110 so as to produce a collimated beam. 130 is a cylindrical lens for condensing exclusively in the direction perpendicular to the photosensitive face 500*a* the collimated light reflected from the parabolic mirror 120, the focal point thereof being located on the photosensitive face 500*a*. 140 is a reflecting mirror for reflecting towards the photosensitive paper 500 the light coming from the cylindrical lens 130. 150 is a liquid crystal shutter containing 640 pixels arranged along the width of the photosensitive paper 500 and comprised of a single scanning electrode and 640 signal electrodes.

The constitution of the head feed mechanism 300 will now be described. 310 is a DC motor. 320 is a rotary encoder comprising a fin 321 and a photointerruptor 323. The fin 321 is provided with 18 apertures 322 and is secured to the rotating shaft of the DC motor 310 so as to rotate as the rotating shaft of the DC motor 310 turns. The photointerruptor 323 is provided with a light-emitting element and a photodetector element disposed opposite to each other with the fin 321 interposed therebetween and the aperture 322 intercepts the light between the light-emitting element and photodetector element as the fin 321 turns. An electrical signal is output synchronous with this interception of the light, allowing the angle of rotation of the DC motor 310 to be detected.

The number of rotation of the DC motor 310 is reduced by a worm gear 350 and gears 361, 362, and 363, and is converted into linear reciprocating motion by pulleys 371 and 372 and a wire 373. In order to move the optical head 100 in its scanning direction, the wire 373 is secured by a wire securing member 101 projecting from the side face of the optical head 100. In this way, the optical head 100 can be moved with precision and at extremely low speed by the head feed mechanism 300 and the head position sensing mechanism 200.

210 and 220 are position sensors comprising photointerruptors secured to a substrate 230. The position of the optical head 100 is detected through blocking of the position sensors 210 and 220 by a light-blocking plate 240.

The method by which an image is produced using this apparatus will now be described. Light is emitted in a sequential manner from the LED array 110 in the order of R, G and B beginning from the top. The light spreads sideways (direction B2), reaching the parabolic mirror 120. The light spreaded sideways by the parabolic mirror 120 is transformed into a collimated beam and reflected in the direction opposite to that of incidence to reach the cylindrical lens 130. The cylindrical lens 130 condenses the light from the parabolic mirror 120 only in the direction perpendicular to the photosensitive paper face. The light condensed by the cylindrical lens 130 is deflected by a substantially 90° angle by means of a flat reflecting mirror 140 and is thereby transformed into a light traveling perpendicular to the photosensitive paper 500. Finally, it passes through the liquid crystal shutter 150 to effect exposure of the photosensitive paper 500. The light having reached the photosensitive paper 500 has essentially been condensed by the cylindrical lens 130 so as to form an image of predetermined width on the photosensitive paper 500.

The light image of predetermined width, produced on the photosensitive face 510, consists of R, G and B lights in order from the scanning direction (direction B1). As the optical head 100 is advanced at a predetermined rate of speed in the direction of arrow BI by the head feed mechanism 300, the light-blocking plate 240 intercepts the light to both the photointerruptors 210 and 220, whereupon it is ascertained that the optical head 100 is in the commence-write position, and the write operation begins.

During the write operation, R is emitted first for predetermined time interval to expose a predetermined area of the photosensitive paper 500. Next, G is emitted over an equivalent time interval to expose the photosensitive paper 500 over an area of the same width. Similarly, B is emitted over an equivalent time interval to expose the photosensitive paper 500 over an area of the same width. By repeating this procedure to expose each given area of the photosensitive paper 500 to light of three colors (RGB), a color image is produced. Exposure times for the three colors are controlled by the liquid crystal shutter 150, allowing full-color images to be obtained.

The write operation will now be discussed in greater detail referring to FIGS. 3(*a*)–3(*f*). In these figures, the optical head moves in the direction indicated by arrow B1 at uniform speed with respect to the photosensitive paper 500. Each of R, G and B beams emitted by the optical head is indicated by two arrows pointing towards the photosensitive paper 500. A beam represented by solid arrows and the hatching between these indicates lighting thereof. For convenience in terms of depicting the color of the light (R, G or B) used for the exposure of the photosensitive paper 500, the photosensitive paper 500 is divided into three layers, exposure with R light being represented by hatching of the first layer, and G and B being represented in similar fashion by hatching of the second and third layers, respectively.

As shown in the drawing, the beams (R, G, B) emitted by the LED light source and having passed through the liquid crystal shutter 150 are made to produce on the photosensitive paper 500 images, each having a width Z2 in the optical head scanning direction (direction of arrow B2) leaving a predetermined gap Z1 among the images. As indicated in the drawing, the relationship between image pitch P, image gap Z1, and image width Z2 can be expressed by P=Z1+Z2. Initially, in the position illustrated in FIG. 3(*a*), the LED light source emits R light only, and the R light (indicated by diagonal lines) forms an image on the photosensitive paper 500, exposing an area of image width Z2. Subsequently, the optical head, still emitting R light, moves at a constant rate of speed in the direction indicated by arrow B1. After being advanced by one pitch, i.e., after having moved a distance equivalent to the image gap Z1 to reach the position illustrated in FIG. 3(*b*), R light emission is terminated, G light is now emitted. Accordingly, the R exposure of the photosensitive paper 500 takes place over a distance equivalent to the image pitch P (162 $\mu$m in this embodiment), this area constituting the image. G light exposure is conducted analogously as illustrated in FIGS. 3(*c*) and 3(*d*), followed by B light exposure as illustrated in FIGS. 3(*e*) and 3(*f*). An image is formed on the photosensitive paper 500 by repetition of the procedure described above. Each iteration of R, G, and B light is referred to as one exposure cycle.

In this embodiment, the exposure cycles are repeated to produce an image on the photosensitive paper. Although not shown in the drawing, in the third exposure cycle a given area is exposed with light of all three colors (R, G, and B).

The lights of the three colors can be arranged so that imaging on the photosensitive paper can be effected at a predetermined image pitch interval in a scanning direction. Each light can be emitted once in a sequential manner following a predetermined sequence while being moved by a distance equivalent to one-fourth of the pitch to make up one exposure cycle. This exposure cycle can be repeated to form images on the photosensitive medium.

During writing of an image onto photosensitive paper by the optical head, the liquid crystal shutter can be used to control the exposure distance for the light from the LED light source over the area corresponding to the respective pixels, thereby affording images of gradated tone.

Light of each of the three colors must be directed precisely onto predetermined locations on the photosensitive paper 500 in accordance with image data. This is achieved in the present embodiment by synchronizing light-emission timing of the LED array 110 and the liquid crystal shutter opening/closing timing with the output of the rotary encoder 320.

As noted earlier, the rotary encoder is provided with 18 apertures used for generating a signal indicating angular position. The rotary encoder makes one full rotation during one exposure cycle; the timing of emission or termination for each color is controlled by apertures obtained by dividing the 18 apertures into three equal sets. Specifically, of apertures 1 through 18, R is controlled through a signal based on the first aperture, G is similarly controlled by the seventh aperture, and B is controlled by the thirteenth aperture. By doing so, deviations in optical head speed over a plurality of lines on the photosensitive paper due to positioning error occurred when the apertures are made in the rotary encoder can be eliminated, making it possible to improve image accuracy.

In view of machining precision and the like, the optimal number of apertures in the rotary encoder is 18 to 24 for this sort of apparatus.

The light-emission timing of the LEDs and the liquid crystal shutter opening/closing timing produced by the rotary encoder 320 will be discussed in greater detail referring to FIGS. 4 through 6.

Figure 4:
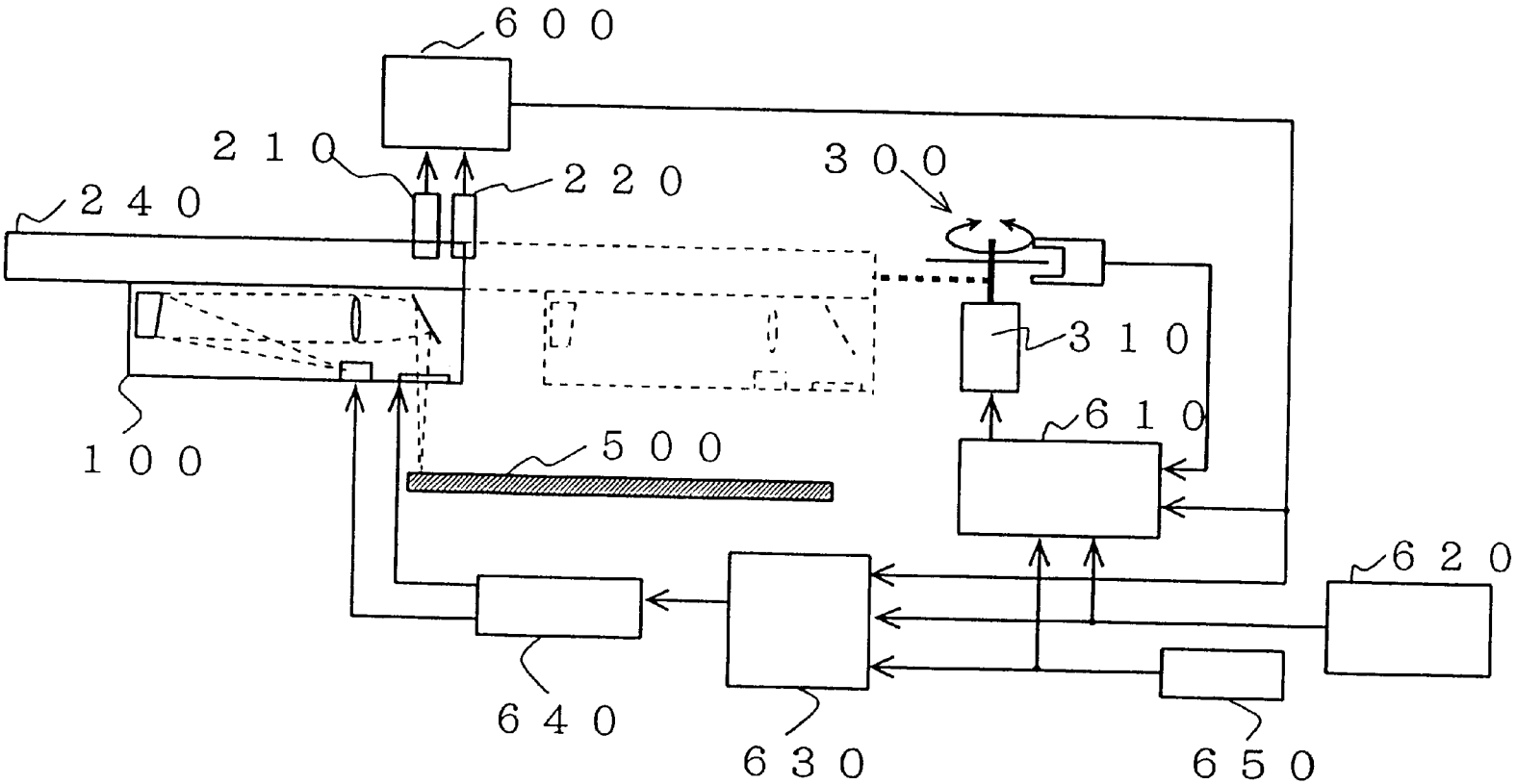
FIG. 4 is a block diagram of the control system in the optical printer apparatus which pertains to the present invention.

FIG. 4 is a block diagram depicting head scanning speed control and exposure timing control in the optical printer apparatus illustrated in FIG. 2. Elements previously described in the context of FIG. 2 are assigned the same symbols and are not discussed to avoid repetition.

As noted earlier, the optical head 100 is moved over a predetermined scan distance by the head feed mechanism 300 to produce an image on the photosensitive paper 500; the solid lines represent the position at the start of the write operation and the broken lines indicate the position at the end of the write operation. 600 is a decoder for decoding the output of the position sensors 210 and 220; an active pulse is output only when both position sensors are ON, position sensor 210 is ON while position sensor 220 is OFF, and position sensor 210 is OFF while position sensor 220 is ON. 610 is a motor drive circuit which houses a PLL circuit. 620 is a controller, usually a personal computer. 630 is a counter. 640 is a control circuit for controlling the operation of the liquid crystal shutter 150 and the LED array 110. 650 is a reference clock.

As noted in the earlier discussion, each of R-, G- and B-lights have to be irradiated at a predetermined rate of speed over a predetermined area on the photosensitive paper 500. As regards the advance speed of the head, the PLL control circuit compares the pulse output from the rotary encoder 320 with the reference clock 650, and controls the DC motor 310 so that it turns at constant rotational speed. LED light-emission timing and liquid crystal shutter opening/closing timing are controlled in a process whereby the pulses output from the rotary encoder 320 are counted by a counter 630, synchronizing the timing for LED light-emission and liquid crystal shutter opening/closing with the output at a predetermined value.

Figure 5:
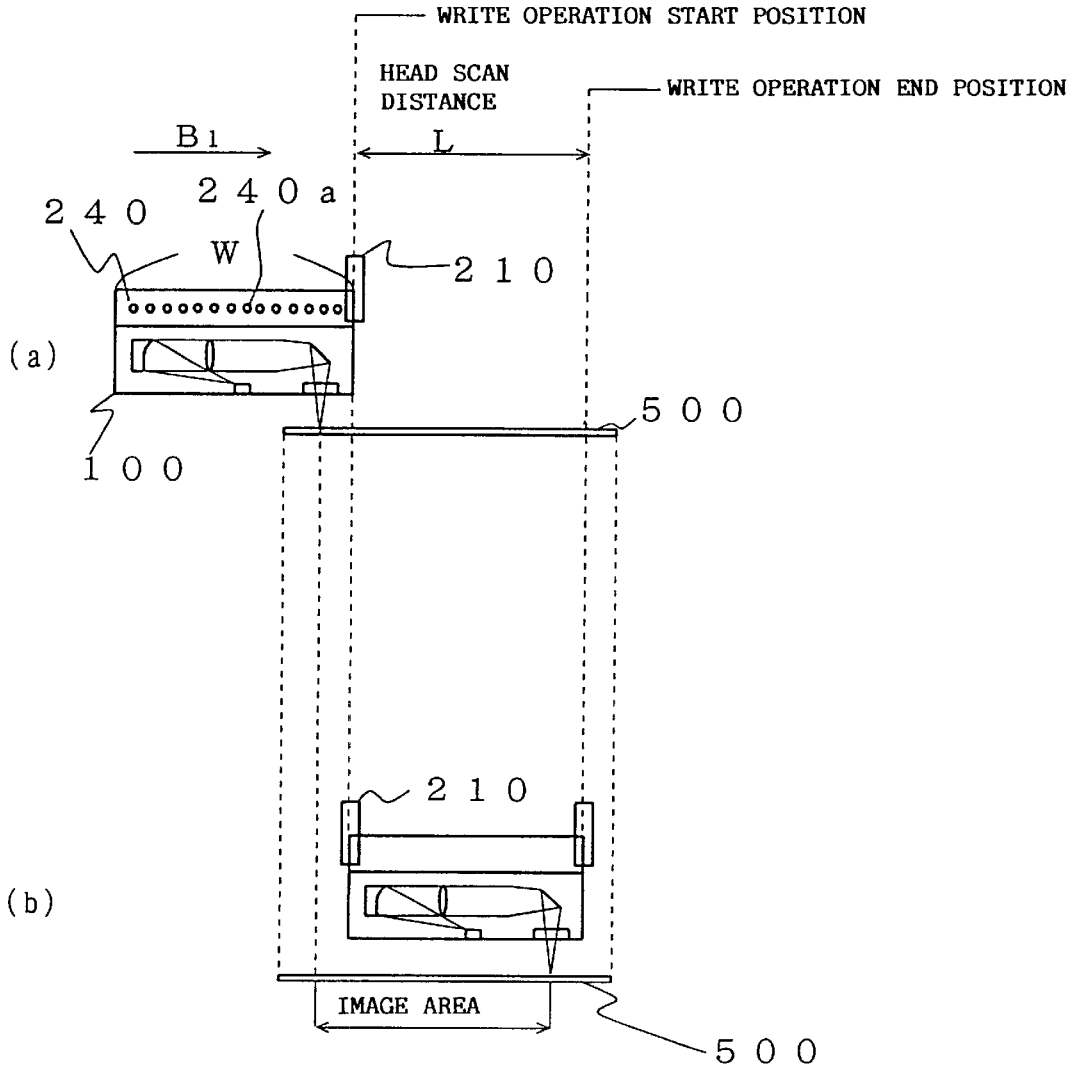
FIG. 5 is a diagram depicting a first method for sensing optical head position in the optical printer apparatus which pertains to the present invention.

FIG. 5 depicts an embodiment wherein the position of the optical head 100 is detected by means of a light-blocking element 240 and a position sensor 210 comprising a photointerruptor.

The light-blocking element 240 is provided with a plurality of holes spaced at equal intervals, and, in association with the motion of the optical head 100, it moves between the light-emitting element and the photodetector element of the position sensor 210, allowing light to pass or to be intercepted, thereby switching the position sensor 210. As in the case of the rotary encoder described earlier, the exposure timing is set by being synchronized with the output of the position sensor 210.

Sensing of the start and end positions for the write operation in this embodiment will now be described. When the optical head 100 moves to the position shown in (a) in the drawing, the light-blocking plate 240 turns on the position sensor 210 to identify the position as a write operation start position, at which point the optical head 100 begins to write on the photosensitive paper 500. The optical head moves in the direction indicated by arrow B1 while writing the image data until reaching the position shown in (b) in the drawing, at which point the light-blocking plate 240 passes the position sensor 210, causing the position sensor 210 to turned off again, whereupon writing to the photosensitive paper 500 by the optical head terminates.

In this way, in the embodiment illustrated in FIG. 5, the two edges of the light-blocking plate 240 are sensed by the position sensor 210 to identify two positions, namely, the write operation start position and the write operation end position. Therefore, the length W of the light-blocking plate 240 must be identical to the scanning distance L for the optical head 100.

Figures 6A, 6B, 6C:
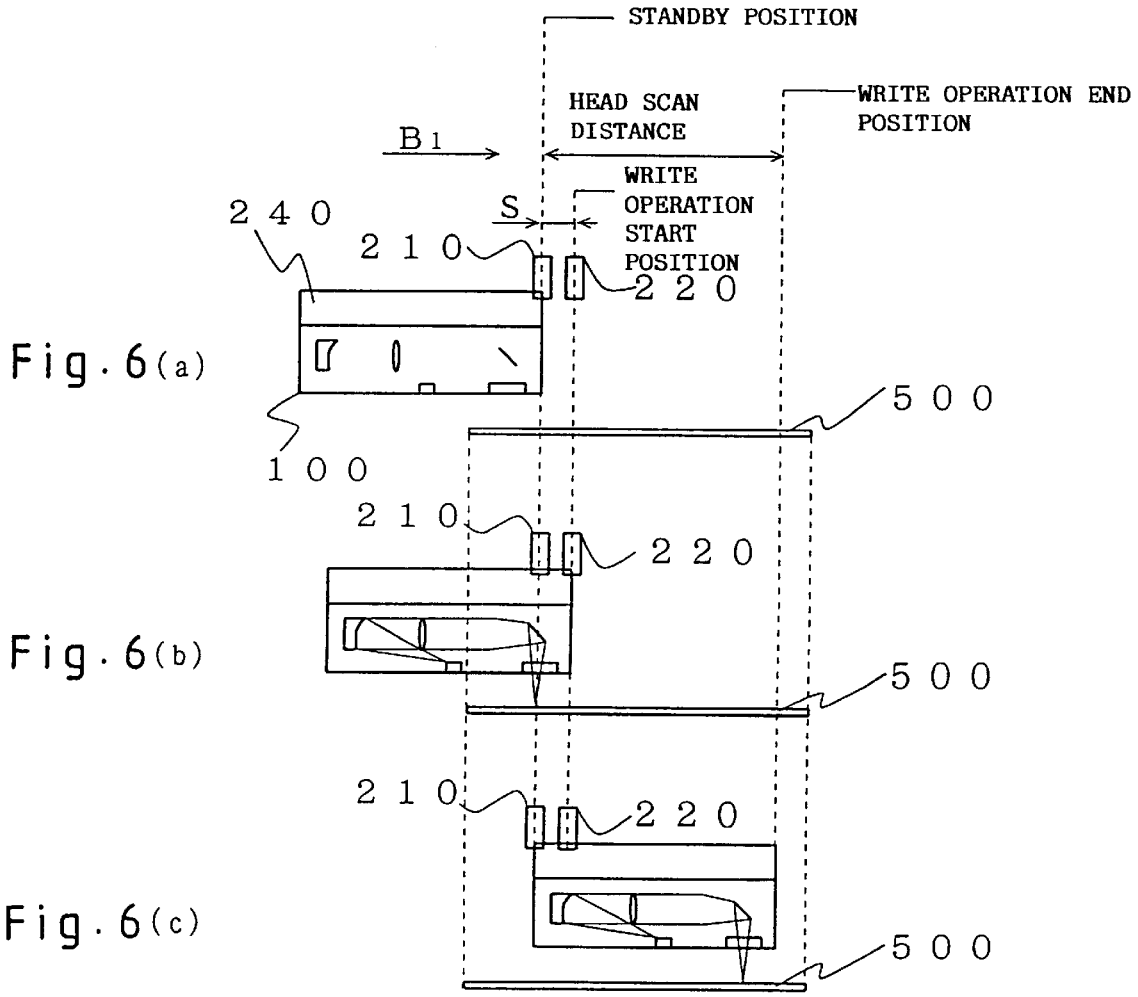
FIGS. 6(*a*)–6(*c*) are diagrams depicting a second method for sensing optical head position in the optical printer apparatus which pertains to the present invention.

FIGS. 6(*a*)–6(*c*) illustrate an embodiment wherein two position sensors 210 and 220 are employed for identifying three positions, namely, the optical head standby position, the write operation start position, and the write operation end position.

In FIG. 6(*a*) the optical head is in standby mode, and both position sensors 210 and 220 are turned off. As the optical head 100 commences scanning, the optical head 100 begins to move in the direction indicated by arrow B1; when it reaches the position illustrated in FIG. 6(*b*), both position sensors 210 and 220 are turned on. This position is write operation start position, at which the writing of image data onto the photosensitive paper 500 is initiated. The optical head 100 continues to move in direction B1 while writing the image data onto the photosensitive paper 500 to effect scanning by the optical head 100. During this time both position sensors 210 and 220 remain turned on. Upon reaching the position shown in FIG. 6(*c*), position sensor 210 is turned off while only the position sensor 220 is turned on. This state corresponds to the write operation end position, at which writing of the image data is terminated. In this embodiment the write operation end position is designated as the point at which the position sensor 210 is OFF and the position sensor 220 is ON; however, it may alternatively be designated as the point at which both position sensors 210 and 220 are turned off.

In this way, in the embodiment illustrated in FIGS. 6(*a*)–6(*c*), the light-blocking plate 240 must turn on both position sensors 210 and 220 at the write operation start position, and thus the length W of the light-blocking plate 240 must be greater than the gap S between the two position sensors 210 and 220.

The general scheme of the optical printer apparatus which pertains to the present invention and processing of the photosensitive paper after exposure will now be discussed referring to FIG. 7.

Elements previously described in the context of FIG. 2 are assigned the same symbols and are not discussed to avoid repetition.

The optical printer apparatus 90 illustrated in FIG. 7 comprises a base 400 and a housing case 410 disposed thereon. The top of the housing case 410 is covered by a lid member 420. The housing case 410 houses an optical head 100 that has the optical mechanism built-in, as well as a head feed mechanism 300.

The base 400 houses control circuitry 430, the photosensitive paper 500, and developing rollers 440.

After the photosensitive paper 500 is exposed in the write operation described above, as a developer is supplied uniformly to the photosensitive paper 500, the photosensitive paper 500 is compressed by the developing rollers 440 so that the developer is applied over the photosensitive face and the photosensitive paper 500 is developped, whereupon the developped photosensitive paper 500 is ejected from the optical printer apparatus 90.

The head support structure and head feed mechanism will now be discussed in detail referring to FIGS. 8 through 11. FIG. 9 is an A—A section of FIG. 8.

Figure 8:
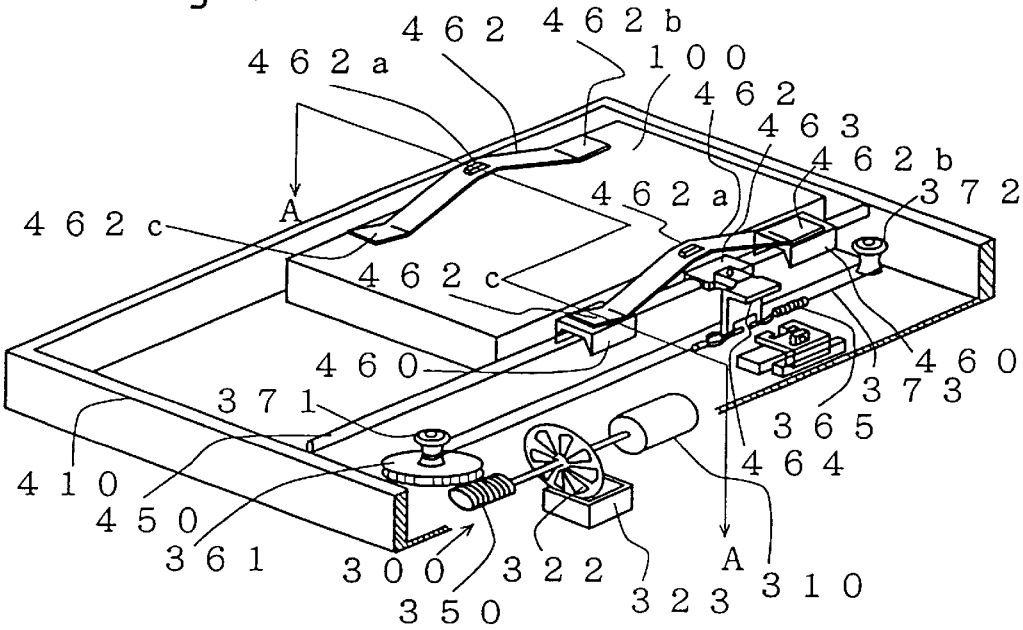
FIG. 8 is a perspective view depicting the head support structure and head feed mechanism of the optical printer apparatus which pertains to the present invention.
Figure 9:
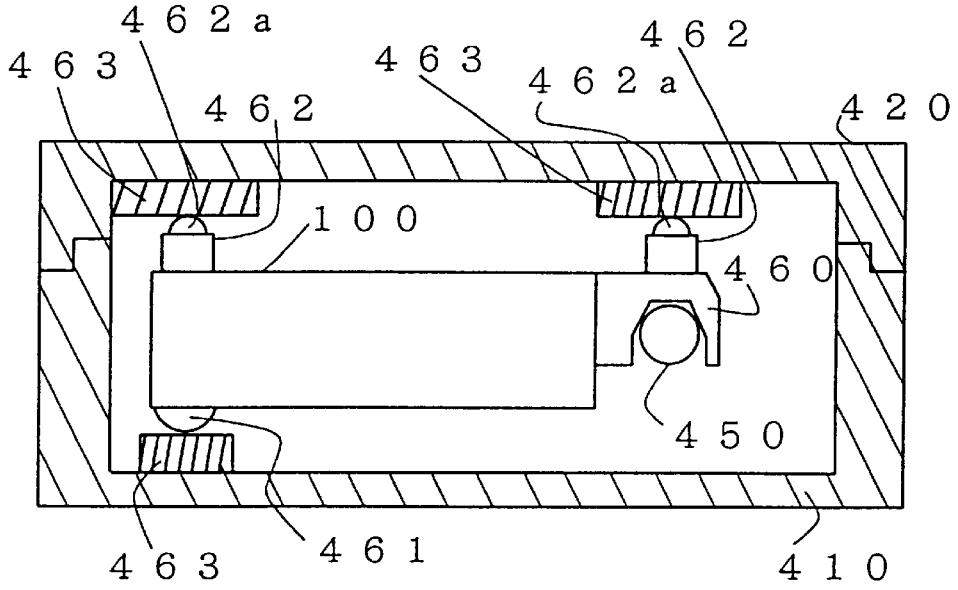
FIG. 9 is a A—A section of FIG. 8.

Referring to FIG. 8, two sliding support members 460 for slidably engaging a guide rod 450 are provided to one side of the optical head 100 on the side face in proximity to the both ends thereof. An abutting support member 461 (FIG. 9) that abuts the bottom face of the housing case 410 is provided to the other side of the optical head 100 at the ends thereof in the approximate center of the bottom face. At a location corresponding to the approximate center point between the two sliding support members 460, there is provided at the side face a joining member 463 linked with and joined to a linking member provided to the optical head feed mechanism 300, described later. Thus, the optical head 100 is supported on one side by the two sliding support members 460 and on the other side by a single abutting support member 461 (FIG. 9) so that the scanning head unit is supported in a stable manner at three points as it is driven to scan parallel to the bottom face of the housing case 410.

Figure 10:
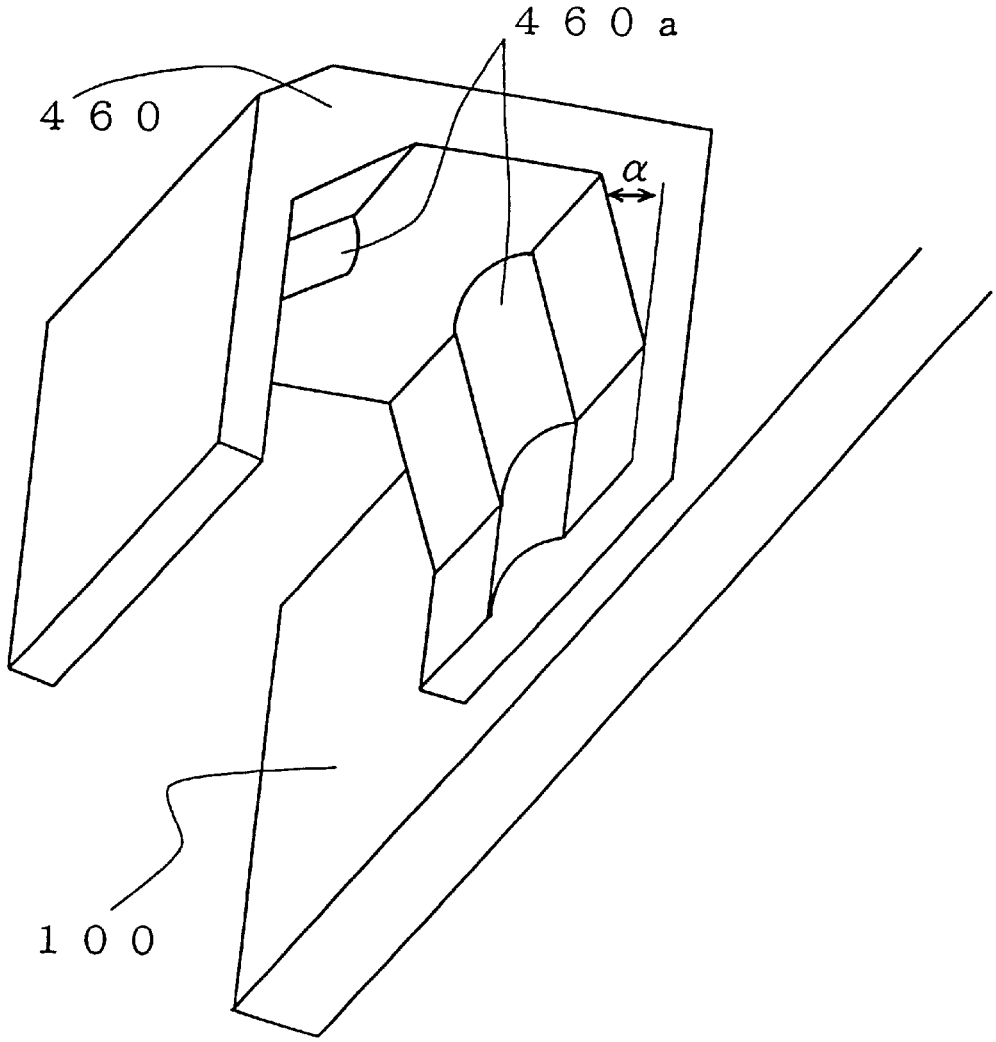
FIG. 10 is a perspective view of the sliding support portion.

The shape of the sliding support members 460 is illustrated in detail in FIG. 10. As shown in FIG. 10, the form of the sliding support members 460 incorporates a synclinal groove for engaging with a guide rod 450. The groove angle $\alpha$ is approximately 35°, and a cylindrical projecting portion 460*a* is formed on the inside wall of the synclinal groove to provide point contact with the guide rod 450. In this particular embodiment a groove angle $\alpha$=approximately 35° is used, the reason being that angles fairly smaller than 35° tend to result in the guide rod 450 biting into the synclinal groove, creating high friction, while angles fairly greater than 35° tend to allow the guide rod 450 to disengage from the synclinal groove. Experiments indicate that the optimal angle for the groove is from 30° through 40. The shape of the abutting support member 461 is a spherical projection designed to provide point contact with the bottom face of the housing case in a manner similar to that of the sliding support members 460.

As shown in FIG. 8 and FIG. 9, the top face of the optical head 100 is provided at both edges thereof with two pressure springs 462 having the form of narrow strips; these serve as pressure elements for pressing the optical head 100 against the bottom face of the housing case 410. The pressure springs 462 are arranged in such a way that the elastic force thereof acts between the top face of the optical head 100 and the back face of the lid member 420, whereby the sliding support members 460 and the abutting support member 461 are made to abut the guide rod 450 and the bottom face of the housing case 410 respectively at predetermined levels of force. The pressure springs 462 are plate springs having an anticlinal shape, the convex side of which faces upward and extending in the scanning direction of the optical head 100; a projecting element 462*a* is located in proximity to the apex of the anticline in order to minimize the area of sliding contact with the back face of the lid member 420. The provision of this projecting element 462*a* serves to prevent the uneven contact of the pressure spring 462 with the lid member 420. Thus, the edge of the spring does not scrape against the lid member 420 and as a result does not produce shavings. If the edge of the spring should happen to scrape against the lid member 420, a groove would be produced in the lid member 420, preventing smooth scanning of the optical head 100. The shavings produced thereby would have an adverse affect on image quality.

As described above, the positioning and attachment means for the pressure springs 462 are such that one of the two pressure springs 462 is disposed substantially right above the two sliding support members 460 provided on one side of the top face of the optical unit 100 (the side on which the head feed mechanism 300 is located). The other pressure spring 462 is disposed in substantially right above the abutting support member 461 located on the other side of the top face of the optical head 100. One end 462*b* of each of the two pressure springs 462 is secured to the optical head 100, with the other end 462*c* constituting a free end that is not constrained with respect to the optical head 100.

The two pressure springs 462 have different spring constants, the spring constant of the spring disposed on the sliding support member 460 side being higher (about three times higher, for example) than the spring constant of the spring disposed on the abutting support member 461 side, thus preventing zigzag run of the optical head during scanning.

As shown in FIG. 9, the contact face of the abutting support member 461 of the optical head 100, which contacts the bottom face of the housing case 410, and the contact faces at which the projecting elements 462*a* of the two pressure springs 462 contact the lid member 420 are provided with slide tape 463 consisting of a friction-reducing material (such as Teflon tape) adhered thereto over the scanning area of the of the optical head 100 in order to minimize friction at the sliding surfaces.

A second embodiment of the head drive mechanism 300 will now be discussed referring to FIG. 8. A point differing from the first embodiment described with reference to FIG. 2 is that the embodiment illustrated in FIG. 2 is provided with a reduction gear mechanism located between the worm wheel 361 and the pulley 371, while the embodiment illustrated in FIG. 8 comprises a worm gear 350, a worm wheel 361, and a pulley 371.

Referring to FIG. 8, rotation of the motor 310 is reduced by means of the worm gear 350 and the worm wheel 361, and is converted to linear reciprocating motion by a wire 373 wound around a drive pulley 371 fixed to the worm wheel 361 and a free pulley 372. The wire 373 is provided with a predetermined tension by means of a coil spring 365 located between the two pulleys 371 and 372, its two ends being secured to a linking element 464. The linking element 464 is secured to a wire securing member 463 of the optical head 100 as described later.

The optical head 100 is assembled by assembling the head feed mechanism 300 and the guide rod 450 at the predetermined locations in the housing case 410 and then mounting the optical head 100 by aligning the two sliding support members 460 thereof with the guide rod 450. Then, the linking element 464 is aligned with the wire securing member 453 of the optical head 100 and secured thereto using a screw or the like. Further, the lid member 420 is attached and secured to the housing case 420 in such a way that the optical head 100 is pressed against the bottom face of the housing case 420 by the two pressure springs 462, completing assembly.

The reduction gear ratio for the worm gear 350, worm wheel 361, and pulley 371 will now be discussed.

The reduction gear ratio for the worm gear 350, worm wheel 361, and pulley 371 is set so that each turn of the worm gear 350 causes the optical head to move by a distance equivalent to one aforementioned image pitch (P=162 $\mu$m).

Figure 11:
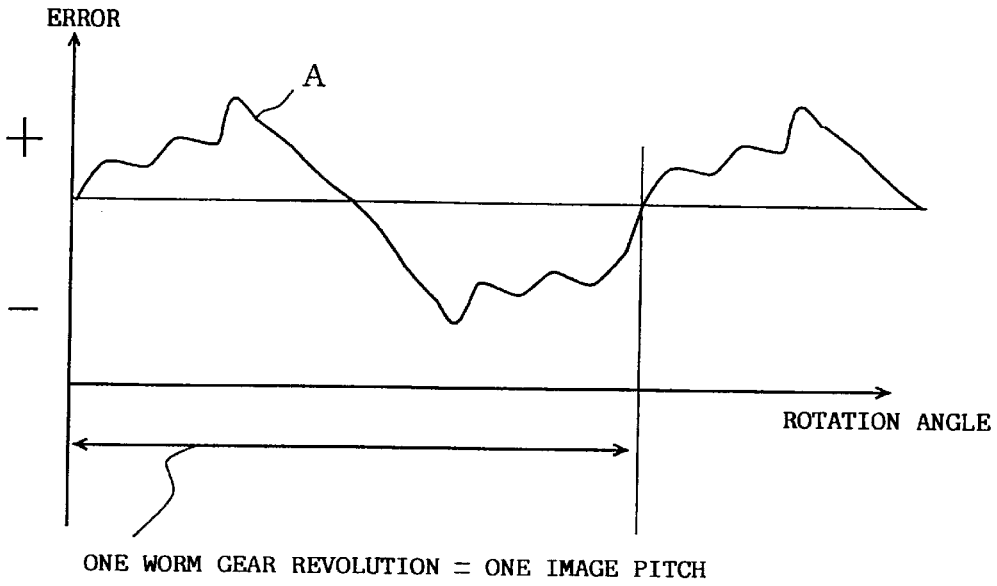
FIG. 11 is a diagram depicting head advance error associated with worm gear rotation.

Graph A given in FIG. 11 shows the displacement error occurring as the optical head 100 advance in association with turning of the worm gear 350, the errors resulting from errors during the machining for shaping the teeth of worm gear 350 and the like. Graph A in the positive area indicates that the optical head 100 is moving fast, while the graph A in the negative area indicates that it is moving at lower speeds. Thus, while the optical head 100 moves at a constant speed overall, there are the speed of motion within a single turn of the worm gear 350. Faster motion results in a shorter exposure time, while slower motion results in a longer exposure time; thus, fluctuations in the speed of motion have significant effect on the image.

In the present invention, the reduction gear ratio for the head drive mechanism 300 is set so that one turn of the worm gear 350 causes the optical head 100 to move by a distance equivalent to one image pitch. Accordingly, variations in exposure time are produced only within the context of a single pixel and do not occur over a plurality of pixels. Thus, regardless of the magnitude of an error in forward displacement, the total exposure time for any individual pixel is constant, affording consistent image quality. This embodiment is designed so that one turn of the worm gear 350 moves the optical head 100 by a distance equivalent to one image pitch, but similar effect can be achieved in a design wherein any arbitrary number (integer) of turns, rather than one turn, of the worm gear 350 corresponds to an advance by one image pitch.

Figure 12:
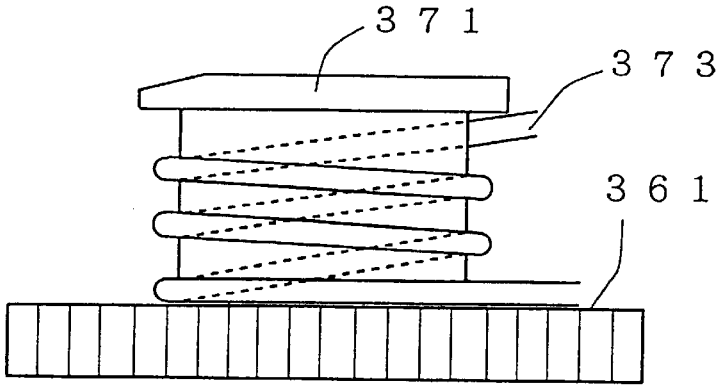
FIG. 12 is a diagram depicting the wire wound around a pulley.

Referring to FIG. 12, in the present invention, the wire is wound around the pulleys 371 and 372 so as not to overlap during rotation, thereby making it possible for the optical head to be advanced maintaining a constant rate of speed.

Next, how to fix the wire 373 to the optical head 100 will be explained referring to FIG. 13 through FIG. 15.

Figure 13:
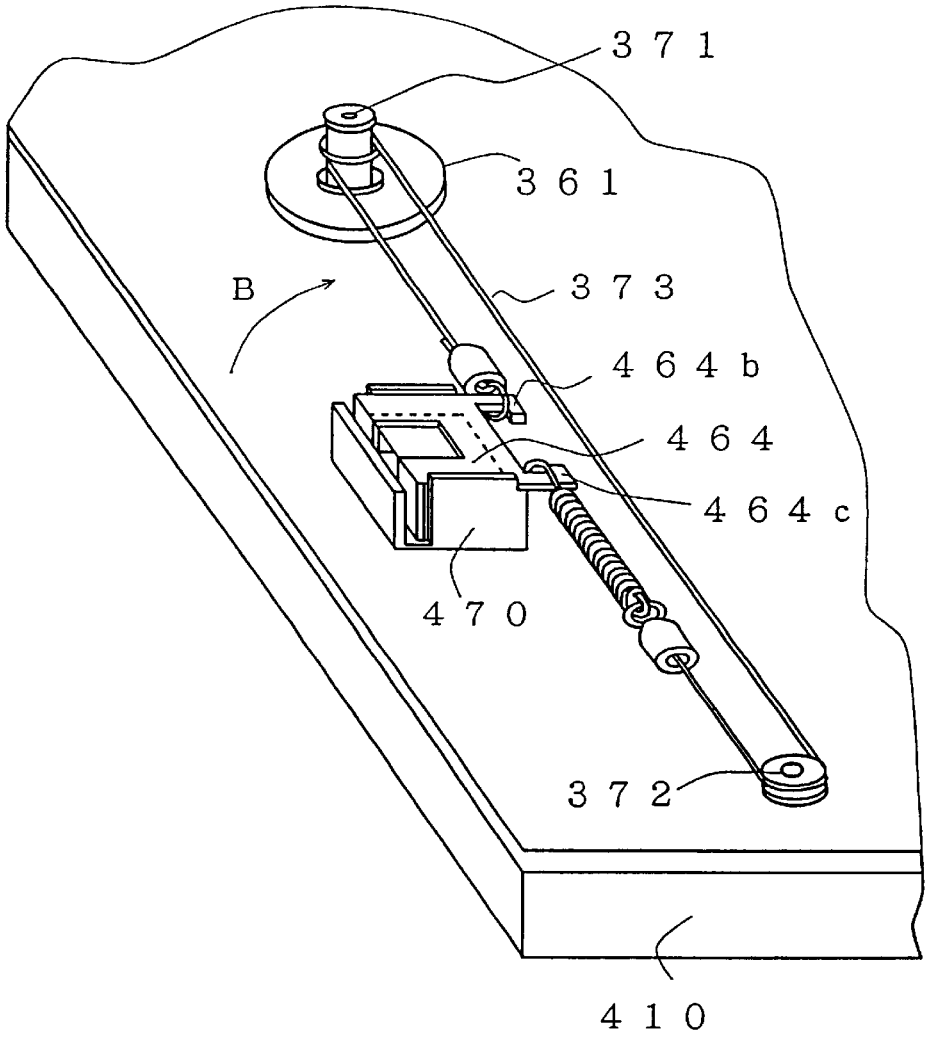
FIGS. 13, 14, and 15 are illustrative diagrams of the procedure of the wire to the optical head.

As shown in FIG. 13, the linking element 464 is mounted on a linking element mounting base 470. As shown in the drawing, the shape of the linking element mounting base 470 corresponds to the L shape of the linking element 464, allowing the linking element 464 to be temporarily held in place.

In this state, one end and the other end of the wire 373 are secured to two engagement members 464*b* and 464*c* provided to the linking element 464, through a coil spring 365 which is provided to give a tension to the wire 373. Thus, the wire 373 can readily be installed on the linking element 464, since the positions of the two engagement members are easily visible and there are no intervening members.

Figure 14:
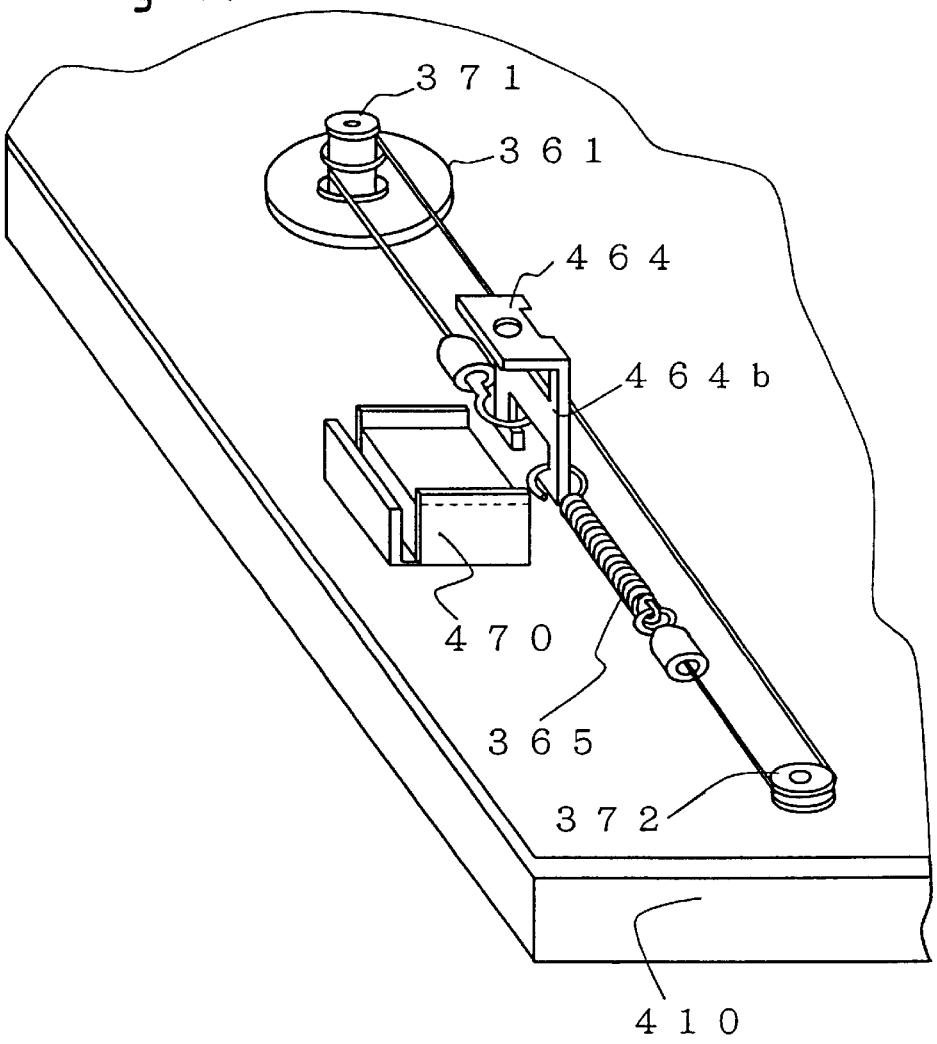

After completing installation of the wire 373, as mentioned previously, since there is an open space above the linking element mounting base 470, the linking element 464 is disengaged from the linking element mounting base 470 and turned approximately 90° in the direction of the arrow B about an axis passing through the engagement members 464*b* and 464*c*, thereby getting the state illustrated in FIG. 14.

Figure 15:
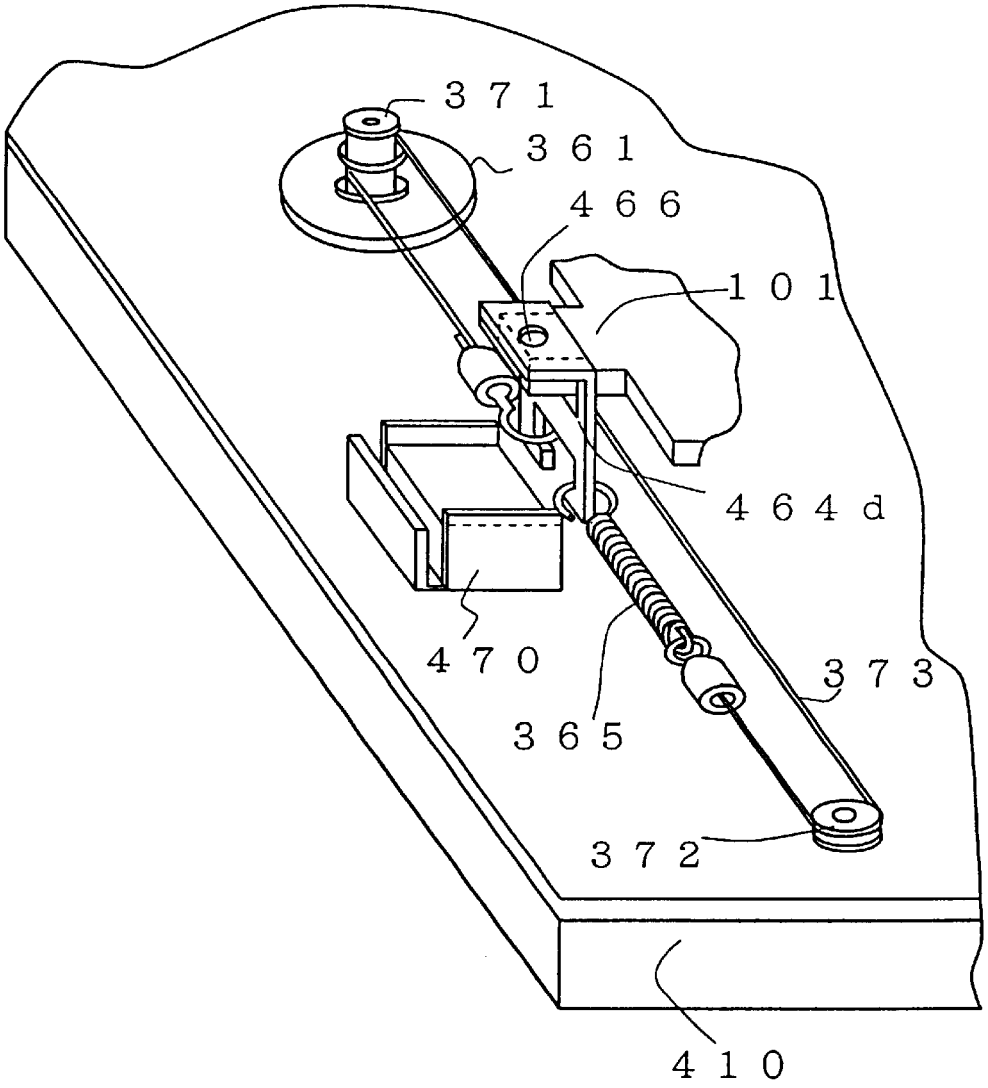
Figure 16:
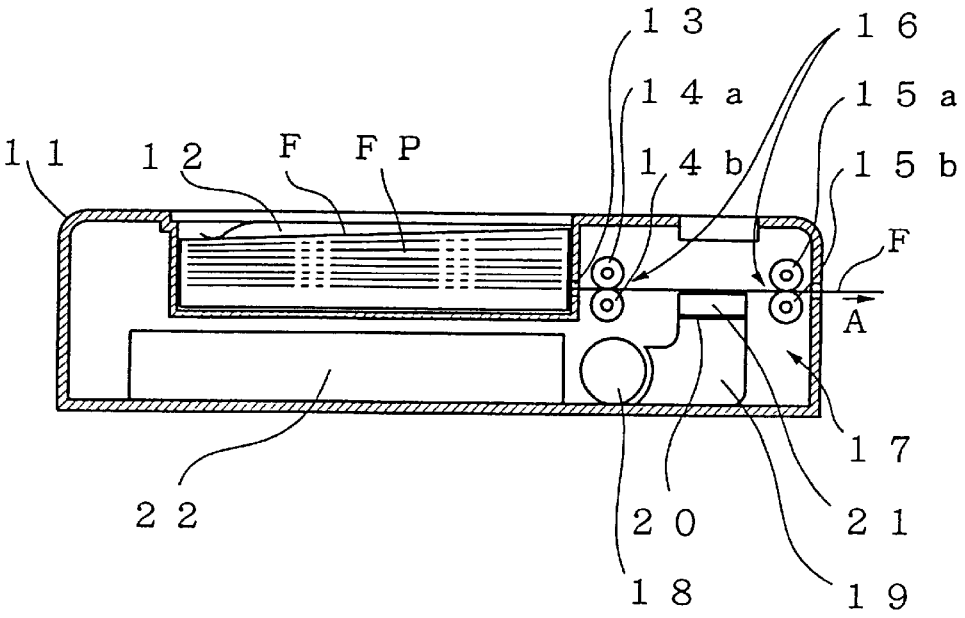
FIG. 16 is a sectional view of an optical printer apparatus of the prior art.

Next, as shown in fig. 15, the wire securing member 101 is made to engage with an opening 464*d* of the linking element 464 and secured thereto by securing means such as a screw to complete the assembly procedure for the wire 373.

What is claimed is:

1. An optical printer apparatus, comprising:

an optical head for irradiating a photosensitive medium with light for exposure to produce an image;

a motor for making the optical head and the photosensitive medium move relative to each other over a predetermined scanning area, said light being irradiated on the photosensitive medium for a predetermined time while the optical head and the photosensitive medium move relative to each other at a predetermined speed in order to produce an image on the photosensitive medium; and displacement sensing means for sensing relative displacement of the optical head with respect to the photosensitive medium, wherein timing of the exposure of the optical head is synchronized with an output of the displacement sensing means.

2. The optical printer apparatus according to claim 1, wherein the displacement sensing means comprises a rotary encoder for outputting a signal synchronized with a rotation of the motor.

3. The optical printer apparatus according to claim 2, wherein the exposure light comprises lights of three colors.

4. The optical printer apparatus according to claim 3, wherein the lights of three colors are a substantially red light (R light), a substantially green light (G light), and a substantially blue light (B light).

5. The optical printer apparatus according to claim 4, wherein the light source for emitting the lights of three colors comprises light emitting diodes (LED).

6. The optical printer apparatus according to claim 3, wherein the lights of three colors are arranged such that imaging on the photosensitive medium is effected at a predetermined image pitch P interval in the scanning direction, each being emitted once in a sequential manner following a predetermined sequence while being moved by a distance equivalent to P/4 to constitute one exposure cycle, this exposure cycle being repeated to form images on the photosensitive medium.

7. The optical printer apparatus according to claim 6, wherein the displacement of the head during one exposure cycle corresponds to one rotation of a fin of the rotary encoder.

8. The optical printer apparatus according to claim 7, wherein the displacement of the optical head, relative to the photosensitive medium, during emission of lights of three colors in one exposure cycle is substantially equivalent to ⅓ pixel length in the head scanning direction of the image formed on the photosensitive medium.

9. The optical printer apparatus according to claim 8, wherein a number of apertures provided to the fin of the rotary encoder is a multiple of 3.

10. The optical printer apparatus according to claim 9, wherein the timing for sequential emission of lights of three colors during one exposure cycle is controlled by three arbitrary points, located at equal angular intervals, of the apertures of the rotary encoder.

11. The optical printer apparatus according to claim 10, wherein the number of apertures is one of 15, 18, and 21.

12. The optical printer apparatus according to claim 11, wherein the head comprises a liquid crystal shutter controlled such that light from the light source is transmitted to or blocked from the photosensitive medium.

13. The optical printer apparatus according to claim 12, wherein the optical head, the photosensitive medium, and the motor are installed within a housing case, and relative motion of the optical head with respect to the housing case is made so as to effect scanning over the entire photosensitive medium.

14. The optical printer apparatus according to claim 13, wherein the rotational motion of the motor is converted to reciprocating linear motion by a wire strung in the direction of head scanning.

15. The optical printer apparatus according to claim 14, wherein the wire is strung between two pulleys disposed a predetermined distance apart in the scanning direction of head, one of the two pulleys being affixed coaxially with a gear, the worm wheel meshing with a gear, and the worm gear being linked to the rotating shaft of the motor, whereby the rotational motion of the motor is converted to reciprocating linear motion of the optical head.

16. The optical printer apparatus according to claim 15, wherein the optical head is advanced by one image pitch, equivalent to pixel length in the scanning direction of head, each time the worm gear rotates a number of times that is an integer.

17. The optical printer apparatus according to claim 16, wherein the number of times of rotation of the worm gear is one.

18. The optical printer apparatus according to claim 15, said one of two pulleys is integrally formed with the gear.

19. The optical printer apparatus according to claim 18, wherein the wire is attached to the scan head by means of a linking element that is separate from the scan head.

20. The optical printer apparatus according to claim 19, wherein the housing case comprises a linking element mounting base for temporarily holding in place the linking element when securing the wire to the linking element.

21. The optical printer apparatus according to claim 20, wherein the linking element comprises two engagement members, spaced apart in the head scanning direction, for attachment of the wire.

22. The optical printer apparatus according to claim 21, wherein the wire is wound around the pulleys in a manner such that the wire will not overlap despite rotation of the pulleys.

23. The optical printer apparatus according to claim 13, wherein the optical head is guided and supported by a guide rod extending in the scanning direction thereof.

24. The optical printer apparatus according to claim 23, wherein the guide rod engages with a groove-shaped engagement member provided to the optical head.

25. The optical printer apparatus according to claim 24, wherein the engagement member provided to the optical head for engaging with the guide rod is a synclinal groove having an opening angle of about 35°.

26. The optical printer apparatus according to claim 25, wherein a projecting member for point contact with the guide rod is provided at the inside of the synclinal groove.

27. The optical printer apparatus according to claim 26, wherein the engagement member for engaging the guide rod is disposed at a position offset from the center of the optical head, in the direction of the width of the optical head, or in the direction orthogonal to the scanning direction and also parallel to the direction of the width of the photosensitive medium.

28. The optical printer apparatus according to claim 27, wherein the optical head is further supported by the housing case at a position apart in its width direction from the engagement members.

29. The optical printer apparatus according to claim 28, wherein the optical head is supported within the housing case by two abutting members disposed some distance apart in the scanning direction.

30. The optical printer apparatus according to claim 29, wherein a lid engaging with the housing case is provided, and spring elements are disposed between the back face of the lid and the optical head so that the optical head is kept pushed towards the bottom of the housing case.

31. The optical printer apparatus according to claim 30, wherein the spring elements comprise at least two elements disposed some distance apart in the direction of optical head width.

32. The optical printer apparatus according to claim 31, wherein of the at least two spring elements, one located on the side closer to the guide rod is made to exert a greater energizing force.

33. The optical printer apparatus according to claim 32, wherein the spring elements are anticlinal plate springs being convex in the upward direction.

34. The optical printer apparatus according to claim 33, wherein a projecting member for reducing sliding contact area with the back face of the lid is provided in proximity to the apex of the anticline.

35. The optical printer apparatus according to claim 34, wherein the plate spring is secured at one end thereof to the optical head, while the other end thereof constituting a free end.

36. The optical printer apparatus according to claim 1, wherein the head displacement sensing means comprises a position sensor, being a photointerruptor provided to either the housing case or the optical head, and a light-intercepting element for switching the position sensor, the light-intercepting element being provided to either the optical head or the housing case.

37. The optical printer apparatus according to claim 36, wherein the light-intercepting element is arranged in the head scanning direction covering a distance, at least substantially equal to the scanning distance of the optical head, and is provided with a plurality of holes to permit light from the photointerruptor to pass.

38. The optical printer apparatus according to claim 36, wherein the position sensor comprises at least two sensors, at least two position sensors being disposed in proximity to a single substrate.

39. The optical printer apparatus according to claim 38, wherein relationships $S<W$, and $L \leqq W<2L$ hold respectively, where L represents the optical head scanning distance, W represents the length of the light-intercepting element in the head scanning direction, and S represents the distance between the two position sensors.

40. The optical printer apparatus according to claim 39, wherein the two position sensors are constituted to sense at least three positions of the optical head.

41. The optical printer apparatus according to claim 40, wherein the three positions are the head standby position, the write operation start position, and the write operation end position.

* * * * *